US009866937B2

(12) United States Patent
Silzle et al.

(10) Patent No.: US 9,866,937 B2
(45) Date of Patent: Jan. 9, 2018

(54) VEHICLE WITH SIDE WALL SPEAKERS

(71) Applicant: Fraunhofer-Gesellschaft zur Foerderung der angewandten Forschung e.V., Munich (DE)

(72) Inventors: Andreas Silzle, Buckenhof (DE); Oliver Hellmuth, Erlangen (DE); Ulrik Heise, Wiener Neudorf (AT); Stefan Finauer, Munich (DE); Christian Stoecklmeier, Spardorf (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 546 days.

(21) Appl. No.: 14/162,589

(22) Filed: Jan. 23, 2014

(65) Prior Publication Data

US 2014/0133673 A1 May 15, 2014

Related U.S. Application Data

(63) Continuation of application No. PCT/EP2012/063002, filed on Jul. 4, 2012.

(Continued)

(51) Int. Cl.

| | |
|---|---|
| ***H04R 1/02*** | (2006.01) |
| ***H04R 3/12*** | (2006.01) |
| ***H04R 5/02*** | (2006.01) |
| ***H04R 1/40*** | (2006.01) |
| ***H04R 5/04*** | (2006.01) |

(52) U.S. Cl.

CPC ..... *H04R 1/028* (2013.01); *H04R 3/12* (2013.01); *H04R 5/02* (2013.01); *H04R 1/403* (2013.01); *H04R 5/04* (2013.01); *H04R 2201/021* (2013.01); *H04R 2201/025* (2013.01);

(Continued)

(58) Field of Classification Search

None

See application file for complete search history.

(56) References Cited

U.S. PATENT DOCUMENTS

| | | | | |
|---|---|---|---|---|
| 4,323,138 A | | 4/1982 | Horner | |
| 5,953,432 A | * | 9/1999 | Yanagawa | H04R 1/403 381/335 |

(Continued)

FOREIGN PATENT DOCUMENTS

| | | |
|---|---|---|
| CN | 2316789 | 4/1999 |
| CN | 1778141 | 5/2006 |

(Continued)

OTHER PUBLICATIONS

Rennlist "Door speakers." http://rennlist.com/forums/928-forum/517462-door-speakers-2.html. pp. 1-15. Aug. 11, 2009-Aug. 12, 2009.*

(Continued)

*Primary Examiner* — Curtis Kuntz
*Assistant Examiner* — Qin Zhu
(74) *Attorney, Agent, or Firm* — Squire Patton Boggs

(57) ABSTRACT

A vehicle includes a side wall, a ceiling and a speaker arrangement including at least one speaker. The speaker arrangement is positioned in or at the side wall and is configured such that a main sound emission direction of the speaker arrangement is directed to the ceiling.

18 Claims, 5 Drawing Sheets

Related U.S. Application Data

(60) Provisional application No. 61/512,523, filed on Jul. 28, 2011.

(52) U.S. Cl.
CPC .. *H04R 2201/401* (2013.01); *H04R 2205/024* (2013.01); *H04R 2499/13* (2013.01)

(56) References Cited

U.S. PATENT DOCUMENTS

| | | | | |
|---|---|---|---|---|
| 8,073,156 | B2 * | 12/2011 | Hutt | H04R 1/345 381/160 |
| 2002/0034308 | A1 * | 3/2002 | Usui | H04R 5/02 381/17 |
| 2003/0035552 | A1 * | 2/2003 | Kolano | G10K 11/28 381/77 |
| 2003/0219137 | A1 * | 11/2003 | Fincham | H04S 1/002 381/302 |
| 2005/0259831 | A1 | 11/2005 | Hutt et al. | |
| 2007/0116298 | A1 * | 5/2007 | Holmi | H04R 5/02 381/86 |
| 2008/0187155 | A1 * | 8/2008 | Hou | H04R 1/02 381/300 |
| 2008/0247575 | A1 | 10/2008 | Hutt et al. | |
| 2009/0316939 | A1 | 12/2009 | Matsumoto et al. | |
| 2012/0263306 | A1 * | 10/2012 | McGowan | H04R 1/403 381/17 |

FOREIGN PATENT DOCUMENTS

| | | | |
|---|---|---|---|
| DE | 102008059239 | | 6/2010 |
| EA | 199900858 | | 4/2000 |
| EP | 1978776 | A1 | 10/2008 |
| JP | H04-126499 | A | 4/1992 |
| JP | H05-344580 | A | 12/1993 |
| JP | 07262196 | | 10/1999 |
| JP | 2004168267 | | 6/2004 |
| JP | 2006045865 | | 2/2006 |
| JP | 2010179880 | | 8/2010 |
| JP | 2011091666 | | 5/2011 |

OTHER PUBLICATIONS

Notification of Reasons for Refusal in co-pending Japanese Patent Application No. 2014-522016 mailed Feb. 17, 2015.

International Search Report from PCT/EP2012/063002 dated Oct. 2, 2012, 3 pages.

Office Action issued by State Intellectual Property Office of People's Republic of China in co-pending Chinese Patent Appl. No. 201280037790 dated Dec. 14, 2015.

Decision to Grant issued by Korean Patent Office in co-pending Korean Patent Appl. No. 10-2014-7002226 dated Mar. 30, 2016.

Office Action issued by Russian Patent Office in co-pending Russian Patent Appl. No. 2014107718 dated Jul. 28, 2015.

* cited by examiner

VEHICLE WITH SIDE WALL SPEAKERS

CROSS-REFERENCE TO RELATED APPLICATIONS

This application is a continuation of copending International Application No. PCT/EP2012/063002, filed Jul. 4, 2012, which is incorporated herein by reference in its entirety, and which claims the benefit of U.S. Provisional Application No. 61/512,523, filed Jul. 28, 2011, which is also incorporated herein by reference in its entirety.

BACKGROUND OF THE INVENTION

The invention relates to a vehicle having at least one speaker in a side wall of the vehicle and more specifically to an automobile having at least one speaker in a center pillar or B-pillar of the automobile.

SUMMARY

According to an embodiment, a vehicle may have: a side wall; a ceiling; and a speaker arrangement comprising at least one speaker; wherein the speaker arrangement is positioned in or at the side wall and is configured such that a main sound emission direction of the speaker arrangement is directed to the ceiling; wherein the vehicle further comprises an audio processor; wherein the speaker arrangement comprises a plurality of speakers, the at least one speaker being one of the plurality of speakers; wherein different speakers of the plurality of speakers are positioned at different heights of the side wall; wherein the audio processor is configured to provide to a first speaker of the plurality of speakers an audio signal and to provide a delayed version of the audio signal to a second speaker of the plurality of speakers; and wherein the second speaker is positioned closer to the ceiling than the first speaker.

It is a core idea of embodiments of the invention that a better sound perception for a passenger sitting in a vehicle can be achieved if a speaker arrangement of the vehicle is arranged in or at a side wall of the vehicle and a main sound emission direction of the speaker arrangement is directed to a ceiling of the vehicle. By directing the main sound emission direction of the speaker arrangement to the ceiling, a diffuse sound perception, for example, a diffuse sound cloud, can be achieved within the passenger compartment of the vehicle and hence, an improved sound perception of envelopment from the side and above can be provided.

The main sound emission direction of the speaker arrangement can be, for example, a main sound emission direction of the at least one speaker. As an example, the at least one speaker can be inclined such that its main sound emission direction is directed to the ceiling.

According to further embodiments, the main sound emission direction of the speaker arrangement can be a combined a sound emission direction of a plurality of speakers of the speaker arrangement.

According to some embodiments, the speakers of the speaker arrangement may be flat mounted speakers having their main sound emission direction not directed to the ceiling. An audio processor can be configured to provide differently delayed versions of an audio signal to different speakers of the plurality of speakers. By choosing suitable delays the main sound emission direction of the complete speaker arrangement can be directed to the ceiling of the vehicle. The delay between different speakers may depend on a distance between the speakers of the speaker arrangement. The speakers can be arranged at different heights of the side wall (e.g. in different distances from the ceiling). Lower speakers may "come early" while higher speakers "come later". In other words, a speaker which is placed closer to the ceiling receives the audio signal with more delay than a speaker which is placed further away from the ceiling. As a rule of thumb, for an inclination of 45 degrees and a distance (in height) of 10 cm between two speakers of the speaker arrangement, the delay between the audio signals provided to the two speakers can be around 0.15 ms.

Furthermore the main sound emission direction of the speaker arrangement may apply for a certain target frequency band of the emitted sound waves of the speakers of the speaker arrangement. As an example this target frequency band can range at least from 500 kHz to 2 MHz. Hence, at least sound waves emitted by the speakers of the speaker arrangement in this target frequency band are directed to the ceiling of the vehicle.

According to further embodiments of the invention, when the at least one speaker is inclined (e.g. with respect to the side wall), the speaker is arranged such that a sound wave emitted by the speaker along the main sound emission direction hits the ceiling of the vehicle and is reflected by the ceiling of the vehicle before it hits a passenger sitting in the vehicle. The ceiling can be configured such that it reflects the sound wave emitted from the speaker in a plurality of different directions so as to generate a diffuse sound cloud within the passenger compartment of the vehicle.

According to some embodiments of the invention the vehicle comprises a sound wave reflector which is arranged at or in the ceiling. The main sound emission direction of the speaker is directed to this sound wave reflector. The use of the sound wave reflector at the ceiling enables a better reflection of the sound wave emitted from the speaker, when compared to only using the ceiling of the vehicle (without the additional sound wave reflector) for reflecting the sound wave emitted by the speaker.

According to further embodiments of the invention, the vehicle comprises a sound processor or audio processor configured to receive an audio signal, to extract a diffuse portion of the audio signal and to provide the diffuse portion to the speaker. In other words, the audio processor can perform a differentiation between a diffuse portion and a directional portion of the audio signal and provides only the diffuse portion to the speaker. The combination of having the diffuse portion of the audio signal provided to the speaker and the main sound emission direction of the speaker being directed to the ceiling, leads to a further improved sound perception for a passenger sitting in the vehicle.

According to further embodiments, the vehicle can comprise a vehicle seat and another speaker. A main sound emission direction of this other speaker is directed to the vehicle seat, for example, a sound wave emitted by the other speaker along the main sound emission direction of the other speaker directly (without reflection) hits a passenger sitting on the vehicle seat. The audio processor can be further configured to extract a directional portion of the audio signal and to provide the directional portion to the other speaker. In other words, the audio processor can be configured to perform a distinction of cases for the audio signal in that it extracts the diffuse portion and the directional portion of the audio signal and provides these two portions to the different speakers. The directional portion is provided to the other speaker having its main sound emission direction directed to the vehicle seat and the diffuse portion is provided to the speaker having its main sound emission direction directed to the ceiling of the vehicle. The distinction of cases between the diffuse portion and the directional portion enables on the one hand a better diffuse sound perception for a passenger sitting on the vehicle seat and on the other hand still a perception of directional sounds.

BRIEF DESCRIPTION OF THE DRAWINGS

Embodiments of the invention will be detailed subsequently referring to the appended drawings, in which.

DETAILED DESCRIPTION OF THE INVENTION

Before embodiments of the invention are described in detail using the accompanying figures, it is to be pointed out that the same or functionally equal elements are given the same reference numbers in the figures and that a repeated description for elements provided with the same reference numbers is omitted. Hence, descriptions provided for elements having the same reference numbers are mutually exchangeable.

In the following a speaker arrangement in a vehicle will be described in more detail. The speaker may be part of an audio sound system which is configured to entertain or inform passengers in the vehicle. The vehicle may be, for example, an automobile, a bus, a truck, a train, a ship, a subway or an airplane. In general, the vehicle may be any means for transporting passengers in the air, on the water, on the ground or in the underground.

Furthermore the vehicle may be a passenger car.

According to embodiments, the speaker may be arranged in or at a side wall of the vehicle so that a sound wave emitted by the at least one speaker in a main sound emission direction is directed to the ceiling or roof of the vehicle. The speaker may be integrated in the side wall or attached, respectively fixed at the side wall. A sound wave which is emitted by the speaker is then reflected at the ceiling of the vehicle and scattered into the passenger compartment. The speaker may be inclined with respect to the side wall or arranged in or at the side wall, so that the main sound emission direction of the speaker is directed to the ceiling of the vehicle. This means, a main sound emission direction of the speaker and the side wall or B-pillar may comprise a certain angle $\alpha$. The angle $\alpha$ may be, for example, between 1° and 90° or between 5° and 45°. The at least one speaker may be part of an audio sound system. According to further embodiments a plurality of speakers may be integrated in or fixed at a side wall of the vehicle. The speakers may be directed to the ceiling of the vehicle.

Figure 1:
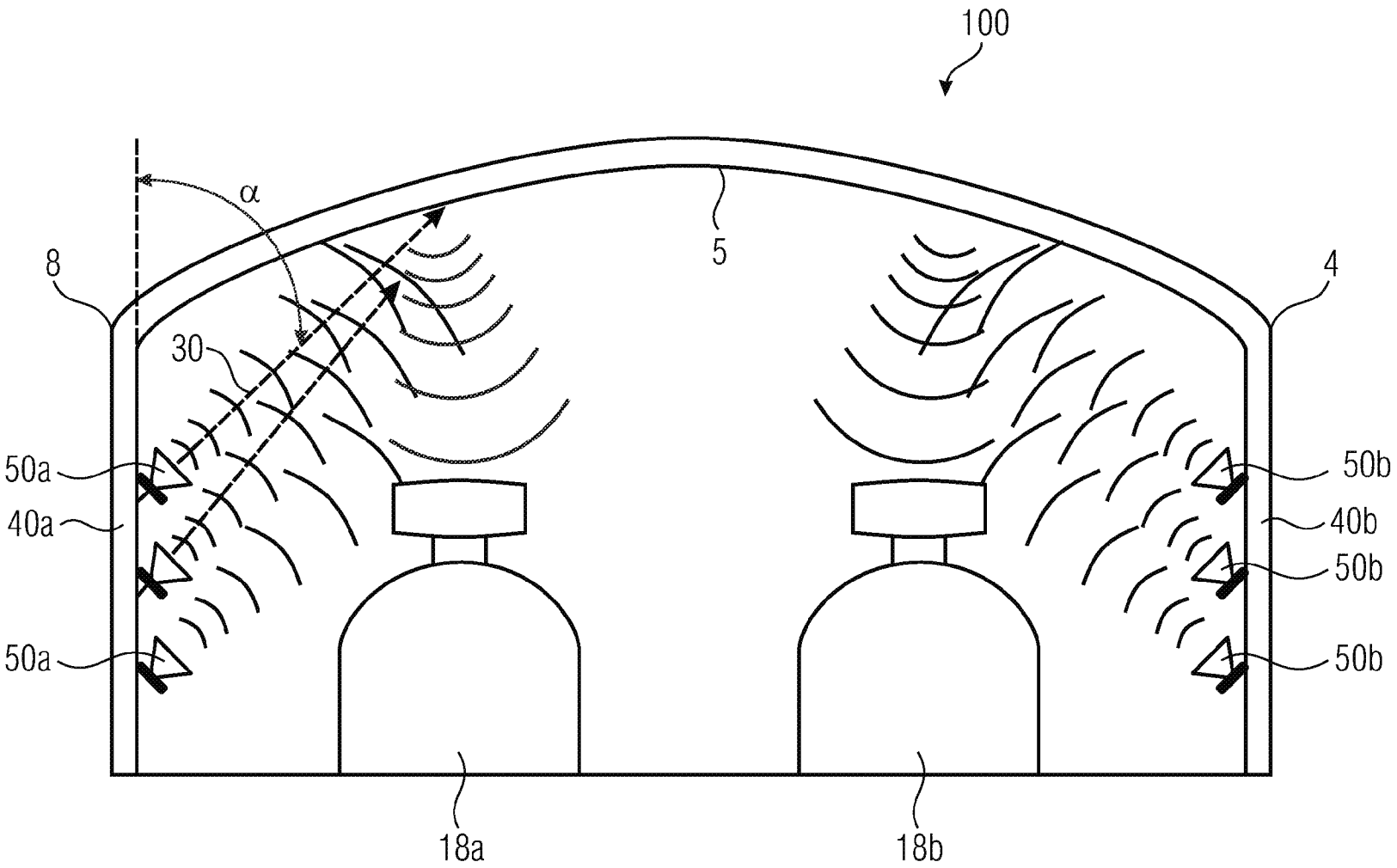
FIG. 1 shows a vehicle according to an embodiment of the invention.

As depicted in the schematic cross sectional view in FIG. 1, according to some embodiments, at least one speaker 50*a* may be integrated in a center pillar or a B-pillar 40*a* of a vehicle 100. The B-pillar may be, for example, a B-pillar of an auto body—an automobile, a truck, a bus or a passenger car, etc. At least one speaker may be inclined and arranged in the B-pillar so that the main sound emission direction of the speaker is directed to the ceiling of the vehicle.

As schematically shown in FIG. 1, speakers may be arranged with respect to a driving direction on a left side 8 and on a right side 4 of the vehicle. The at least one speaker 50 may be inclined with respect to the B-pillar 40 so that a main sound emission direction 30 is directed to the vehicle ceiling 5. A sound wave emitted by a speaker 50*a* fixed or integrated in the left B-pillar 40*a* of the vehicle may hit the vehicle ceiling 5 above a left vehicle seat 18*a* and the speaker 50*b* inclined and integrated or fixed at the right B-pillar 40*b* may hit the ceiling 5 of the vehicle above a right vehicle seat 18*b*. The vehicle seats may be front seats of an automobile, in other embodiments the seats may be back seats. In further embodiments the vehicle, for example, in a train, bus, airplane etc. may have a plurality of seats. The inclined integrated or fixed speakers 50*a* in the left B-pillar 40*a* may emit a sound wave which is reflected above a left vehicle seat and the right speakers 50*b* may be inclined and integrated in a right B-pillar 40*b* so that an emitted sound wave 30 is reflected above the right vehicle seat 18*b*. This means, a passenger who is sitting on the left vehicle seat or on the right vehicle seat may perceive a diffuse sound wave which is reflected at the ceiling of the vehicle. By means of the reflection of the sound wave at the ceiling of the vehicle it is possible to generate a diffuse sound perception for passengers in the vehicle. The sound wave which is reflected at the ceiling of the vehicle may be scattered in different directions within the passenger compartment. As a consequence, passengers sitting, for example on a rear seat in an automobile, may have the perception of a diffuse sound cloud from above.

In general the main sound direction of the at least one speaker may be directed to any location on the vehicle ceiling. Thus, the main sound direction of the at least one speaker may be directed to, for example, the center of the vehicle ceiling or to a location above a vehicle seat. Speakers which are arranged at a left and at a right side wall or B-pillar can emit sound waves which are directed to the same location on the vehicle ceiling according to some embodiments.

To summarize, FIG. 1 shows a cross-sectional view of a vehicle 100 according to an embodiment of the invention. The vehicle 100 comprises a speaker arrangement comprising a plurality of left speakers 50*a* which are arranged at the left B-pillar 40*a* of the vehicle 100. The main sound emission directions of the left speakers 50*a* are directed to the ceiling 5 of the vehicle 100. Therefore, also the main sound emission direction of the speaker arrangement is directed to the ceiling 5 of the vehicle 100. Sound waves emitted from the left speakers 50*a* hit the ceiling 5 and are reflected or are scattered into the passenger compartment, for example, so as to hit a passenger sitting on the left seat 18*a*. Furthermore, the vehicle 100 comprises a further speaker arrangement comprising a plurality of right speakers 50*b* which are arranged at the right B-pillar 40*b* of the vehicle 100. The main sound emission directions of the right speakers 50*b* are directed to the ceiling 5 of the vehicle 100. Therefore, also the main sound emission direction of the further speaker arrangement is directed to the ceiling 5 of the vehicle 100. Hence, sound waves emitted by the plurality of right speakers 50*b* hit the ceiling 5 and are reflected or are scattered into the passenger compartment, so as to hit a passenger sitting on the right seat 18*b*.

According to some embodiments of the invention, the (different) main sound emission directions of the plurality of left speakers 50*a* can be directed to the same location or to different locations of the ceiling 5 of the vehicle 100. Furthermore, the (different) main sound emission directions of the plurality of right speakers 50*b* can be directed to the same location or to different locations of the ceiling 5 of the vehicle 100.

According to further embodiments of the invention, the vehicle 100 may comprise only one left speaker 50*a* and only one right speaker 50*b*.

As can be seen from FIG. 1, the left speakers 50*a* could be arranged such that the sound waves emitted by the left speakers 50*a* hit the ceiling 5 above the left seat 18*a*. Furthermore, the right speakers 50*b* can be arranged such that sound waves emitted by the right speakers 50*b* hit the ceiling 5 above the right seat 18*b*. Nevertheless, as already described, the left speakers 50*a* and the right speakers 50*b* can be also arranged such that sound waves emitted by the speakers 50*a*, 50*b* hit the ceiling 5 of the vehicle 100 in the center of the ceiling 5 (for example at a location of the ceiling 5 above a center tunnel of the vehicle 100). Furthermore, the speakers 50*a*, 50*b* can be arranged at different heights of the respective pillar 40*a*, 40*b*. Or in other words, different speakers 50*a*, 50*b* of one and the same speaker arrangement can be arranged in different distances from the ceiling 5 of the vehicle.

According to further embodiments of the invention, at least one of the left speakers 50*a* may be arranged such that its main sound emission direction hits the ceiling 5 above the right seat 18*b* and at least another left speaker 50*a* can be arranged such that its main sound emission direction hits the ceiling 5 above the left seat 18*a*. Furthermore, also at least one of the right speakers 50*b* may be arranged such that its sound emission direction hits the ceiling 5 above the left seat 18*a* and at least another right speaker 50*b* may be arranged such that its main sound emission direction hits the ceiling 5 above the right seat 18*b*.

As an example, the left seat 18*a* can be a driver's seat and the right seat 18*b* can be a co-driver's seat (e.g. for vehicles with a left-hand drive) or the right seat 18*b* can be a driver's seat and the left seat 18*a* can be a co-driver's seat (e.g. for vehicles with a right-hand drive).

In general, the vehicle 100 may be a car, such as a passenger car.

Figure 2:
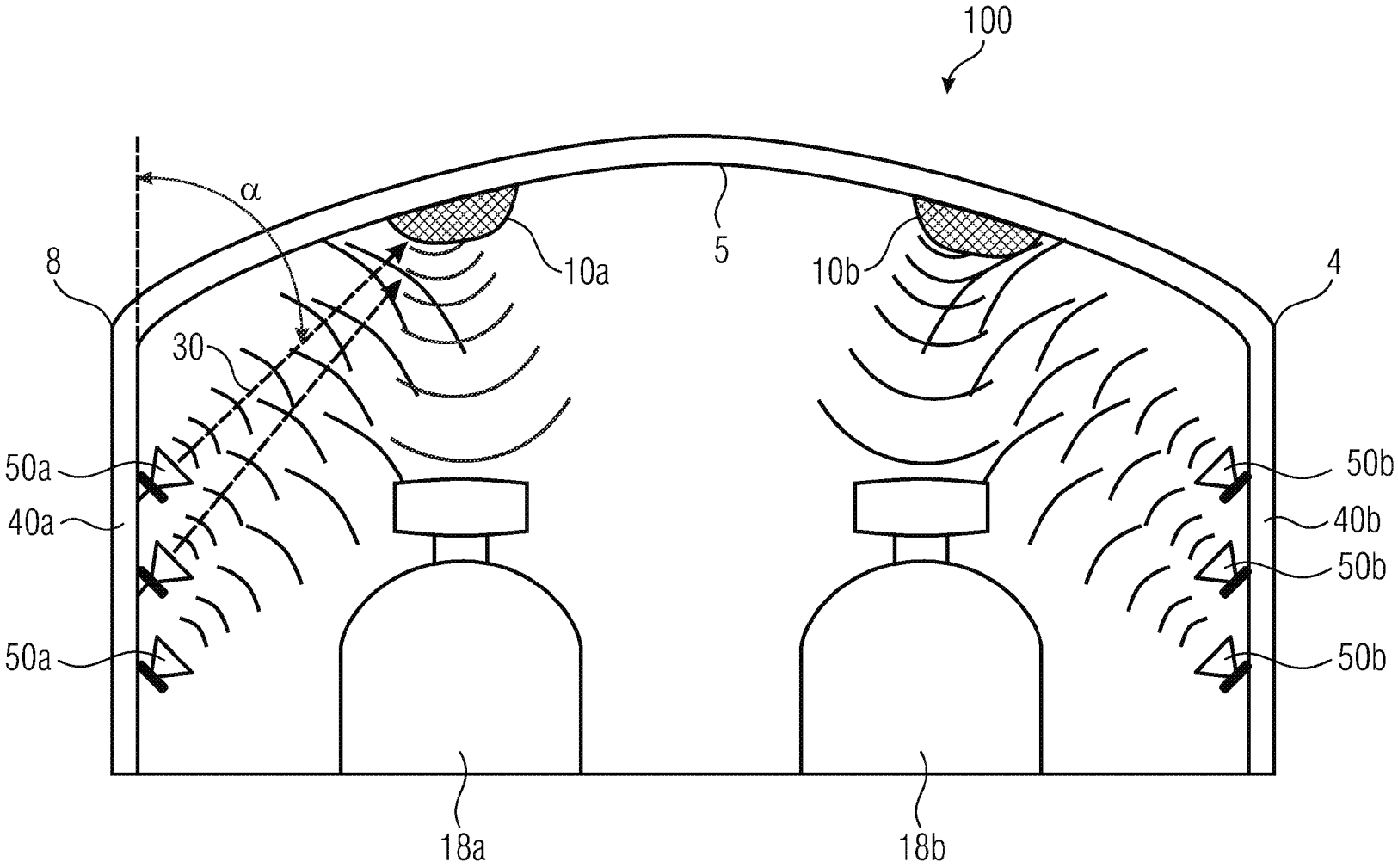
FIG. 2 shows a vehicle according to a further embodiment of the invention.

As it is schematically shown in the cross-section of an automobile, in FIG. 2, at least one sound wave reflector 10 may be arranged or fixed at the ceiling 5 of the vehicle. The sound wave reflector 10 may comprise a material which is harder than the surrounding vehicle ceiling 20. The sound wave reflector 10 may be a separate element which is mountable at the vehicle ceiling. In some embodiments, the sound wave reflectors may have a concave surface so that a sound wave which is emitted from the speaker and which is reflected at the sound wave reflector is scattered or directed in many directions within the passenger compartment. The sound wave reflector may comprise an area of 50 $cm^2$ to 10,000 $cm^2$, 100 $cm^2$ to 6,000 $cm^2$, or 200 $cm^2$ to 3,000 $cm^2$.

The speakers which are integrated or just arranged or fixed at the side wall or in the center pillar, respectively B-pillar can have a size, for example, between 1 cm and 10 cm. The speaker 50 may be a simple and cheap loud speaker. The speaker may comprise a diameter between 1 cm to 10 cm, or between 3 cm to 5 cm. The speaker may be controlled by an audio sound system so that, for example, different sound signals can be emitted from the speaker arranged at the left sidewall or arranged at the left B-pillar and from the speaker arranged at the right sidewall or arranged at the right B-pillar. The left and the right side wall respectively, the left or the right B-pillar may be arranged opposite to each other. As it is schematically shown in FIG. 2, above each vehicle seat, for example, above a left front seat 18*a* and above a right front seat 18*b*, a sound wave reflector 10*a*, 10*b* may be arranged.

According to other embodiments a common sound wave reflector may be arranged above a left and a right vehicle seat at the vehicle ceiling. The sound wave reflector may be made, for example, of plastic, synthetic material, metal, wood, etc. The sound wave reflector may have a different surface than the rest of the vehicle ceiling. The sound wave reflector may be configured to reflect a sound wave better than the remaining vehicle ceiling. This means, the sound wave reflector may have smaller sound wave absorption than the surrounding vehicle ceiling. The sound wave reflector 10 may have a higher sound wave reflectivity than the vehicle ceiling 20. The sound wave reflector 10 may be part of the vehicle ceiling and formed integrally. In other embodiments the sound wave reflector may be a separate element which is mounted at the vehicle ceiling. A sound wave which is emitted from the speaker integrated or fixed at a side wall or a B-pillar of a vehicle may be reflected with a smaller sound wave loss at the sound wave reflector 10 than a sound wave reflected at the surrounding normal vehicle ceiling 20.

It should be clear that the exact arrangement of the speaker in the side wall or, for example, in a B-pillar can be different in other embodiments and also an exact position, shape, size, material and surface structure of the sound wave reflector can be different and optimized in further embodiments. Those embodiments are also included herein. The sound wave reflector 10 material may be harder than the material of the surrounding vehicle ceiling. In some embodiments the emitted sound wave may generate a diffuse sound cloud in the passenger compartment.

In other embodiments the speakers which are integrated in the side wall or in the B-pillar of a vehicle may emit directed surround sound signals for passengers sitting in the passenger compartment.

To summarize, FIG. 2 shows a cross-sectional view of the vehicle 100 of FIG. 1 with an additional first sound wave reflector 10*a* and an additional second sound wave reflector 10*b*. The first sound wave reflector 10*a* is located at the ceiling 5 of the vehicle 100 above the left vehicle seat 18*a* and the second sound wave reflector 10*b* is located at the ceiling 5 above the right seat 18*b* of the vehicle 100.

The main sound emission directions of the left speakers 50*a* are directed to the first sound wave reflector 10*a* such that sound waves emitted by the left speakers 50*a* are reflected or are scattered into the passenger compartment by the first sound wave reflector 10*a*.

Furthermore, the main sound emission directions of the right speakers 50*b* are directed to the second sound wave reflector 10*b* such that the sound waves emitted by the right speakers 50*b* are reflected or are scattered into the passenger compartment by the second sound wave reflector 10*b*.

The sound wave reflectors 10*a*, 10*b* can be configured to reflect the sound waves emitted from the speakers 50*a*, 50*b* in a plurality of different directions within the passenger compartment of the vehicle 100 so as to generate the perception of a diffuse sound cloud in the vehicle 100.

Furthermore, the left speakers 50*a* can be arranged such that the main sound emission directions hit the first sound wave reflector 10*a* at different locations of the sound wave reflector 10*a*. Nevertheless, the sound wave reflector 10*a* can be configured to reflect each sound wave received from the left speakers 50*a* into a plurality of different directions. Hence, the diffuse sound perception is improved furthermore as sound waves emitted by different speakers of the left speakers 50*a* hit the first sound wave reflector 10*a* at different locations of the sound wave reflector 10*a* and as each sound wave emitted from one of the left speakers 50*a* is reflected into a plurality of different directions.

Hence, the number of reflection directions into which the sound waves emitted by the left speakers 50*a* are reflected is increased by letting the main sound emission directions of the different left speakers 50*a* hit the left sound wave reflector 10*a* at different locations.

The same may also apply for the right speakers 50*b* and the second sound wave reflector 10*b*.

Figure 3:
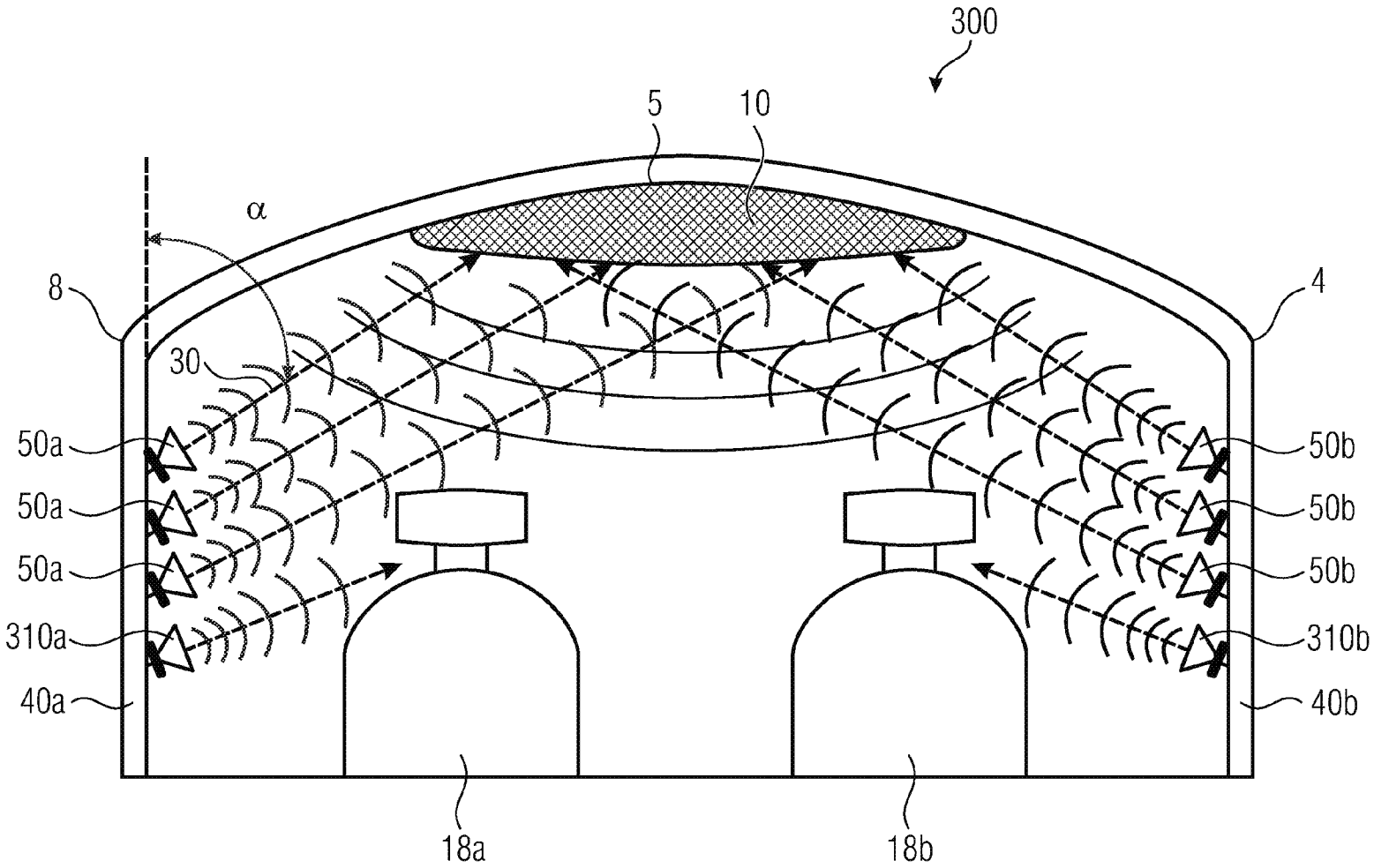
FIG. 3 shows a vehicle according to a further embodiment of the invention.

FIG. 3 shows a cross-sectional view of a vehicle 300 according to a further embodiment of the invention.

The vehicle 300 shown in FIG. 3 differs from the vehicle 100 shown in FIG. 2, in that instead of having the two sound wave reflectors 10*a*, 10*b*, the vehicle 300 comprises a common sound wave reflector 10 located at the ceiling 5 of the vehicle 300.

As can be seen from FIG. 3, the main sound emission directions of the left speakers 50*a* and the main sound emission directions of the right speakers 50*b* are all directed to the common sound wave reflector 10. The sound wave reflector 10 is configured to reflect the sound waves emitted by the left speakers 50*a* and the right speakers 50*b* into a plurality of directions into the passenger compartment of the vehicle 300, so as to generate the perception of a diffuse sound cloud.

As an example, the vehicle 300 can further comprise an audio processor which is configured to provide audio signals to the left speaker 50*a* and the right speaker 50*b*. Especially in the embodiments shown in FIG. 3, such audio processor could be configured to provide the same audio signal to the left speakers 50*a* as to the right speakers 50*b*. Hence, although the left speakers 50*a* are arranged at the left B-pillar 40*a* and the right speakers 50*b* are arranged at the right B-pillar 40*b*, the left speakers 50 a and the right speakers 50*b* can be configured to receive one and the same (diffuse) audio signal or diffuse portion of an audio signal.

Furthermore, the left speaker 50*a* and the right speaker 50*b* may be arranged such that the main sound emission directions of different speakers hit the sound wave reflector 10 at different locations at the sound wave reflector 10, so as to generate a plurality of different directions, in which the sound waves emitted by the speakers 50*a*, 50*b* are reflected.

The common sound wave reflector 10 can be arranged in the center of the roof 5 (e.g. above a center tunnel of the vehicle 300). Furthermore, the sound wave reflector 10 can extend from a location of the ceiling 5 above the left vehicle seat 18*a* to a location of the ceiling 5 above the right vehicle seat 18*b*.

Furthermore, the vehicle 300 comprises a further left speaker 310*a* and a further right speaker 310*b*.

The function of the further left speakers 310*a* and the further right speakers 310*b* will be described in more detail in the following using the example of the vehicle 300 shown in FIG. 3. Nevertheless, according to further embodiments of the invention, these further speakers 310*a* and 310*b* may be implemented in any other embodiment of the invention (such as in the vehicle 100 shown in FIG. 1 or the vehicle 100 shown in FIG. 2).

Furthermore, according to further embodiments of the invention, instead of having the further left speakers 310*a* and the further right speakers 310*b*, only one of these further speakers may be provided.

The further left speaker 310*a* is arranged at the left B-pillar 40*a*. A main sound emission direction of the further left speaker 310*a* is directed to the left vehicle seat 18*a*. Hence, a sound wave emitted by the further left speaker 310*a* directly (without reflection) hits a passenger sitting on the left vehicle seat 18*a* (assuming the left vehicle seat 18*a* is in an upright position). Furthermore, the further right speaker 310 *b* is arranged at the right B-pillar 40*b*. A main sound emission direction of the further right speaker 310*b* is directed to the right vehicle seat 18*b*. Hence, a sound wave emitted by the further right speaker 310*b* directly (without reflection) hits a passenger sitting on the right vehicle seat 18*b*. According to further embodiments of the invention, the further left speaker 310*a* and the further right speaker 310*b* can be arranged at other positions in the vehicle 300 (such as in a door of the vehicle 300 or in a dashboard of the vehicle 300). It is only important that the main sound emission directions of the further speakers 310*a*, 310*b* are directed to the vehicle seats 18*a*, 18*b* of the vehicle 300 such that the sound waves emitted by the further speaker 310*a*, 310*b* directly (without reflection) hit a passenger sitting on the respective vehicle seat 18*a*, 18*b*. As an example, the sound emission directions of the further speakers 310*a*, 310*b* may be directed to a head rest of the respective vehicle seat 18*a*, 18*b* such that the sound waves emitted by the further speakers 310*a*, 310*b* directly hit a head of a passenger sitting on the respective vehicle seat 18*a*, 18*b*.

As already described, a vehicle according to an embodiment of the invention can comprise an audio processor which is configured to provide audio signals to be emitted by the left speakers 50*a* and the right speakers 50*b* to the left speakers 50*a* and the right speakers 50*b*. Furthermore, such audio processor can be configured to provide audio signals to be emitted by the further left speaker 310*a* and the further right speaker 310*b* to the further left speaker 310*a* and the further right speaker 310*b*.

Figure 4:
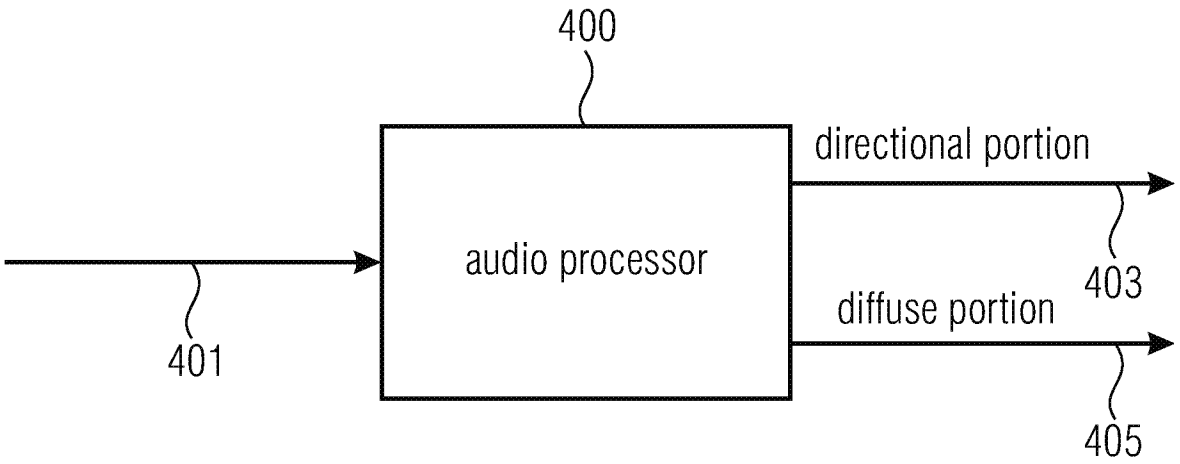
FIG. 4 shows an audio processor as it may be used in embodiments of the invention.

FIG. 4 shows a block schematic diagram of such an audio processor 400, which can be used in embodiments of the invention.

The audio processor 400 is configured to receive an audio signal 401 and to extract a diffuse portion 405 of the audio signal 401. The diffuse portion 405 can be provided by the audio processor 400 to the left speakers 50*a* and/or the right speakers 50*b*. In general, the audio processor 400 can be configured to provide the diffuse portion 405 of the audio signal 401 to the speakers of a vehicle according to an embodiment of the invention which have their main sound emission direction directed to the ceiling 5 of the vehicle (such as the speakers 50*a*, 50*b*).

Furthermore, the audio processor 400 is additionally configured to extract a directional portion 403 of the audio signal 401. The directional portion 403 can be provided by the audio processor 400 to the further left speaker 310*a* and/or the further right speaker 310*b*. In general, the directional portion 403 of the audio signal 400 can be provided by the audio processor 400 to a speaker of a vehicle according to an embodiment of the invention, which has its main sound emission direction directed to a passenger seat, such that a sound wave emitted by the speaker directly hits the passenger sitting on the seat (without being reflected before).

As an example, the audio signal 401 may be a multichannel audio signal comprising the directional portion 403 and the diffuse portion 405. The diffuse portion 405 typically has no directional information, whereas the directional portion 403 comprises such directional information. As an example, the directional portion 403 may comprise a left audio channel signal and a right audio channel signal, wherein the left audio channel signal can be provided to the further left speaker 310*a* and the right audio channel signal can be provided to the further right speaker 310*b*.

Figure 5:
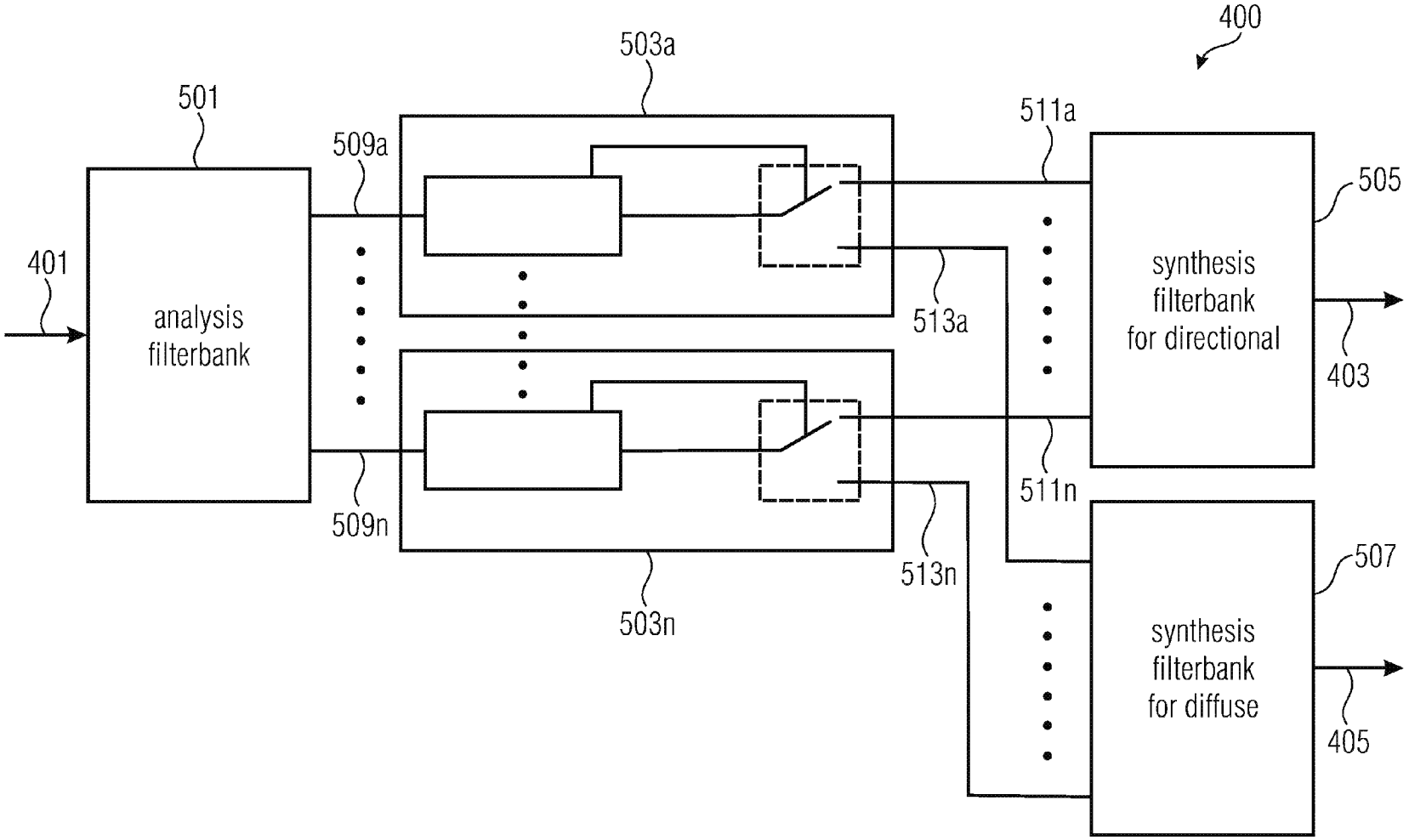
FIG. 5 shows a possible implementation for the audio processor shown in FIG. 4.

FIG. 5 shows in a block schematic diagram a possible implementation for the audio processor 400.

The audio processor 400 comprises an analysis filterbank 501, a plurality of decider stages 503*a*-503*n*, a synthesis filterbank 505 for the directional portion 403 and a synthesis filterbank 507 for the diffuse portion 405.

The analysis filterbank 501 is configured to receive the audio signal 401 and to provide a plurality of frequency subbands 509*a*-509*n* of the audio signal 401. Only, as an example, the analysis filterbank 501 may be configured to perform a Fourier transformation, such as a short time Fourier transformation to derive the plurality of frequency subbands 509*a*-509*n*. Furthermore, each of the decider stages 503*a*-503*n* is configured to receive one of the plurality of frequency subbands 509*a*-509*n*. Each of the decider stages 503*a*-503*n* is configured to decide if a current subband signal of the received frequency subband 509*a*-509*n* comprises directional information or not. If the current subband signal comprises such directional information, the current subband signal is provided to the synthesis filterbank 505 for the directional portion 403 and if the current subband signal does not comprise such directional information, the current subband signal is provided to the synthesis filterbank 507 for the diffuse portion 405.

Hence, cases may occur in which certain frequency subbands of the plurality of frequency subbands 509*a*-509*n* are only provided to the synthesis filterbank 505 for the directional portion 403, while other frequency subbands 509*a*-509*n* are provided only to the synthesis filterbank 507 for the diffuse portion 405.

To summarize, each of the decider stages 503*a*-503*n* is configured to perform a distinction of cases, if a current subband signal in a received frequency subband 509*a*-509*n* corresponds to the directional portion 403 or the diffuse portion 405 and accordingly provides this current subband signal of the frequency subbands 509*a*-509*n* either to the synthesis filterbank 505 for the directional portion 403 or the synthesis filterbank 507 for the diffuse portion 405.

The synthesis filterbank 505 for the directional portion 403 receives the subband signals 511*a*-511*n* from the deciding stages 503*a*-503*n* which correspond to the directional portion 403 and provides based on this received subband signals 511*a*-511*n* the directional portion 403 of the audio signal 401. As an example, the synthesis filterbank 507 for the directional portion 403 can be configured to perform an inverse Fourier transformation, to derive the directional portion 403 in the time domain.

Furthermore, the synthesis filterbank 507 for the diffuse portion 405 is configured to receive from the decider stages 503*a*-503*b* the subband signals 513*a*-513*n* which correspond to the diffuse portion 405. The synthesis filterbank 507 for the diffuse portion 405 is configured to derive based on this received subband signals 513*a*-513*n* in the different frequency subbands 509*a*-509*n* the diffuse portion 405 of the audio signal 401. As an example, the synthesis filterbank 505 for the diffuse portion 405 can be configured to perform an inverse Fourier transformation, to derive the diffuse portion 403 in the time domain.

The directional portion 403 may further comprise different audio channel signals for different audio channels, such as a left audio channel signal which is provided to the further left speaker 310*a* and a right audio channel signal which is provided to the further right speaker 310*b*.

In the following a short example for the directional portion 403 of the audio signal 401 and the diffuse portion 405 of the audio signal 401 shall be given.

Imaging the recording of a speech in a natural environment to derive the audio signal 401. The audio signal 401 then comprises the speech of which was recorded with a microphone in directly in front of a speaker and furthermore the sounds of nature, like a sound of the sea or a chirping of birds. Hence, the sounds of the sea and the chirping of birds can form the diffuse portion 405 of the audio signal 401 and the recorded speech of the speaker forms the directional portion 403 of the audio signal 401. By having the audio processor 400 dividing the audio signal 401 in the directional portion 403 and the diffuse portion 405 and furthermore by having the (indirect) speakers 50*a*, 50*b* and the (direct) speakers 310*a*, 310*b* a very realistic reproduction of the recorded sounds can be achieved in a vehicle according to an embodiment of the invention.

Although in the embodiments described above, the speakers 50*a*, 50*b* are inclined such that their main sound emission directions hit the ceiling 5 of the vehicle 100, 300 the speakers may be also flat mounted speakers having their main sound emission directions not directed to the ceiling but being configured to receive differently delayed versions of an audio signal. Hence, a resulting main sound emission direction of the speaker arrangement or the further speaker arrangement comprising the left speakers 50*a* or the right speakers 50*b* can be directed to the ceiling 5 of the vehicle 100, 300, using a phased array technique as already described in the introductory part of the application. As furthermore described, the speakers 50*a*, 50*b* which are arranged closer to the ceiling 5 of the vehicle 100, 300 receive a more delayed version of an audio signal than the speakers 50*a*, 50*b* arranged further away from the ceiling 5 of the vehicle 100, 300, so as to direct the main sound emission direction of the speaker arrangement or the further speaker arrangement to the ceiling 5 of the vehicle 100, 300. As an example, the audio processor 400 described in conjunction with FIG. 4 and FIG. 5 can be configured to differently delay the diffuse portion 405 for the different speakers of the speaker arrangement and the further speaker arrangement to direct the main sound emission directions of the speaker arrangement and the further speaker arrangement to the ceiling 5 of the vehicle 100, 300. The different delays applied to the diffuse portion 405 for different speakers depend on the desired inclination of the main sound emission directions and the distance between the respective speakers of the speaker arrangement and the further speaker arrangement.

According to some embodiments the speaker arrangement comprises at least 3 speakers 50*a* which are arranged in different heights (above each other) in or at the side wall or B-pillar 40*a*. In an advantageous embodiment the speaker arrangement comprises at least 5 speakers which are arranged in different heights in or at the side wall or B-pillar 40*a*. The same may apply for the further speaker arrangement.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the invention. It is therefore intended that the following appended claims be interpreted as including all such alterations, permutations and equivalents as fall within the true spirit and scope of the invention.

The invention claimed is:

1. A vehicle comprising:

a side wall;

a ceiling;

a soundwave reflector arranged at or in the ceiling;

and a speaker arrangement comprising at least one speaker;

wherein the speaker arrangement is positioned in or at the side wall and is configured such that a main sound emission direction of the speaker arrangement is directed to the soundwave reflector arranged at or in the ceiling;

wherein the vehicle further comprises an audio processor;

wherein the speaker arrangement comprises a plurality of speakers, the at least one speaker being one of the plurality of speakers;

wherein different speakers of the plurality of speakers are positioned at different heights of the side wall;

wherein the audio processor is configured to provide to a first speaker of the plurality of speakers an audio signal and to provide a delayed version of the audio signal to a second speaker of the plurality of speakers; and wherein the second speaker is a higher speaker being positioned closer to the ceiling than the first speaker and wherein the first speaker is a lower speaker being positioned further away from the ceiling than the second speaker, such that the audio signal is provided to the lower speaker and the delayed version of the audio signal is provided to the higher speaker.

2. The vehicle according to claim 1, further comprising:

a vehicle seat;

wherein the speaker arrangement is configured such that the main sound emission direction is directed to a location at the ceiling above the vehicle seat.

3. The vehicle according to claim 2, further comprising a further vehicle seat and a further speaker arrangement comprising at least one further speaker;

wherein the further speaker arrangement is positioned and configured such that a further main sound emission direction of the further speaker arrangement is directed to a location at the ceiling above the further vehicle seat.

4. The vehicle according to claim 3, wherein the further speaker arrangement is arranged in or at the same side wall as the speaker arrangement.

5. The vehicle according to claim 3, wherein the further speaker arrangement is arranged in or at a further side wall of the vehicle.

6. The vehicle according to claim 5, wherein the side wall is a left side wall of the vehicle and the further side wall is a right side wall of the vehicle.

7. The vehicle according to claim 3, wherein the vehicle seat is a left vehicle seat and the further vehicle seat is a right vehicle seat.

8. The vehicle according to claim 1, wherein the at least one speaker is inclined such that a sound wave emitted by the at least one speaker directly hits the ceiling.

9. The vehicle according to claim 1, wherein main sound emission directions of the plurality of speakers are not directed to the ceiling of the vehicle.

10. The vehicle according to claim 1, wherein the side wall comprises a pillar; and wherein the speaker arrangement is arranged in or at the pillar.

11. The vehicle according to claim 1, wherein the vehicle is a passenger car and the side wall comprises a B-pillar; and wherein the speaker arrangement is arranged in or at the B-pillar.

12. The vehicle according to claim 1, wherein a sound wave absorption of the sound wave reflector is smaller than a sound wave absorption of the remaining ceiling.

13. The vehicle according to claim 1, wherein the sound wave reflector is configured to reflect a received sound wave emitted by the speaker arrangement in a plurality of different directions within a passenger compartment of the vehicle.

14. The vehicle according to claim 1, wherein the audio processor is configured to receive an audio signal, to extract a diffuse portion of the audio signal and to provide the diffuse portion to the at least one speaker.

15. The vehicle according to claim 14, further comprising:

a vehicle seat; and another speaker, a main sound emission direction of which is directed to the vehicle seat; and wherein the audio processor is further configured to extract a directional portion of the audio signal and to provide the directional portion to the other speaker.

16. The vehicle according to claim 1, further comprising:

a further speaker arrangement comprising at least one further speaker;

wherein the further speaker arrangement is positioned and configured such that a further main sound emission direction of the further speaker arrangement is directed to a different location at the ceiling than the main sound emission direction of the speaker arrangement; and wherein the audio processor is configured to provide a first audio signal to the speaker arrangement and a second audio signal to the further speaker arrangement, wherein the first audio signal and second audio signal are independent from each other.

17. The vehicle according to claim 1, wherein the at least one speaker is a first left speaker; and wherein the side wall is a left side wall of the vehicle and comprises a left B-pillar;

wherein the speaker arrangement is positioned in or at the left B-pillar;

wherein the vehicle further comprises:

a right side wall comprising a right B-pillar;

a further speaker arrangement comprising at least a first right speaker, the further speaker arrangement being positioned in or at the right B-pillar and configured such that a main sound emission direction of the further speaker arrangement is directed to the ceiling of the vehicle; and a left seat, a right seat, a second left speaker and a second right speaker;

wherein a main sound emission direction of the second left speaker is directed to the left seat and a main sound emission direction of the second right speaker is directed to the right seat.

18. The vehicle according to claim 17, wherein the audio processor is configured to receive an audio signal, to extract a diffuse portion of the audio signal and a directional portion of the audio signal; and wherein the audio processor is configured to provide at least a left audio channel signal comprised in the directional portion to the second left speaker and a right audio channel signal comprised in the directional portion to the second right speaker and the diffuse portion to the first left speaker and the second left speaker.

* * * * *